United States Patent [19]

Loder

[11] Patent Number: 4,586,631

[45] Date of Patent: May 6, 1986

[54] DISPENSING PACKAGE FOR SHEETS

[75] Inventor: Harry A. Loder, Mahtomedi, Minn.

[73] Assignee: Minnesota Mining and Manufacturing Company, St. Paul, Minn.

[21] Appl. No.: 693,148

[22] Filed: Jan. 22, 1985

Related U.S. Application Data

[63] Continuation-in-part of Ser. No. 595,236, Apr. 2, 1984.

[51] Int. Cl.[4] ..... B65H 1/04

[52] U.S. Cl. ..... 221/58; 221/61

[58] Field of Search ..... 221/26, 33, 44–63, 221/305; 225/106; 312/50, 60, 61

[56] References Cited

U.S. PATENT DOCUMENTS

| | | | |
|---|---|---|---|
| 2,598,050 | 5/1952 | Guyer | 221/52 X |
| 2,890,791 | 6/1959 | Wenzel | 221/48 X |
| 3,604,562 | 9/1971 | Loeffler | 221/56 X |
| 4,416,392 | 11/1983 | Smith | 221/45 |

FOREIGN PATENT DOCUMENTS

| | | | |
|---|---|---|---|
| 793745 | 4/1958 | United Kingdom | 221/63 |

*Primary Examiner*—F. J. Bartuska

*Attorney, Agent, or Firm*—Donald M. Sell; James A. Smith; John C. Barnes

[57] ABSTRACT

A convenient dispensing package for a stack of adhesive-coated notepaper comprising a box for containing a stack of sheets. The box is formed with an opening in the cover into which flaps project from the edges of the opening and which flaps terminate in opposed edges which grasp the sheets as they are dispensed. A block of resilient compressible foam is placed in the box on the side of the stack opposite the opening to urge the sheets in the stack toward the dispensing opening such that they may be dispensed one at a time and not have a curl imparted to sheets in the lower part of the stack.

6 Claims, 3 Drawing Figures

DISPENSING PACKAGE FOR SHEETS

This application is a continuation-in-part application of copending application Ser. No. 595,236 filed Apr. 2, 1984.

BACKGROUND OF THE INVENTION

1. Field of the Invention

This invention relates to an improved package for dispensing individual sheets of notepaper from a stack in the package. In one aspect, the present invention relates to an improvement in packages for individually dispensing sheet material adhered together along one edge by a peelable adhesive layer therein removal of one article withdraws one end of the next article which can then be separated without withdrawing the said next article.

2. Description of the Prior Art

The present invention provides an improvement in a dispenser for dispensing serially sheets of material which are provided in a stack wherein each sheet is releasably adhered to the next adjacent sheet along an end with each sheet adhered to the next adjacent sheet along alternately opposite edges of successive sheets.

U.S. Pat. No. 4,416,392 (Smith), issued Nov. 22, 1983 and assigned to the assignee of this application, discloses a dispenser for dispensing sheets of material wherein each sheet is adhered to the next adjacent sheet by a narrow band of adhesive material with the adhesive coated on the lower side of each sheet on alternately opposite edges of successive sheets. In the embodiments of the dispenser shown in the patent the sheets were dispensed from the stack through a fixed opening in the dispenser, and in one embodiment the stack of sheets is moved upwardly as they were dispensed toward the dispensing opening by a movable platform which was spring-urged toward the opening. This construction was usable as a refillable desk dispenser and permits the stack of sheets to have greater height, but, requires numerous parts.

The disposable package for the sheets of the parent application Ser. No. 595,236 permits the dispensing of the sheets throughout a large stack. It is noticed, however, that as the sheets in the stack become depleted the dispensing action of pulling the free end of the exposed sheet and the buckling of the next sheet, results in the buckling of the next sheet taking place more closely to the marginal edge coated with the adhesive and the second sheet folds near the area contacted by the adhesive. This results in the second sheet, adjacent its free end being curved. The curve being such that the dispensed free end of the second sheet droops toward the cover and is not extending straight from the opening and away from the cover.

To reduce the curling of the sheets during dispensing it has been determined that all the sheets should be positioned near the top of the package. The first sheets dispensed did not have the curl. The present invention affords an improvement in the dispensing package to reduce the objectionable curl as the last of the sheets were dispensed and still provide a disposable product.

The present invention affords a means for dispensing individual sheets in a manner which makes the dispensing of all the sheets very uniform without any inconsistency or deleterious effect on the sheets.

SUMMARY OF THE INVENTION

The present invention provides an improved package for a stack of sheet material such as utilized for notes, routing slips, labels, color coding, place marks, messages, or reminders. The sheets are releasably adhered along alternately opposite edges of successive sheets such that the sheets are adhered together in a stack but are readily peeled apart when a peeling force is placed on the sheets adjacent said edges. The dispenser comprises a box-like package having at one end a pair of slits running generally parallel to each other and parallel to the edges of the box with a centrally disposed transverse slit defining a dispensing opening substantially centrally thereof. The box-like package is formed of box board and contains a stack of the sheet material. As the sheet material is dispensed from the box each successive sheet exits the box through the slit. The slit defining the opening is preferrably cut in a wave form so the opening is defined between mating undulating edges. The undulating edges are spaced from a score line in the box board and the edges project from the plane of the package. The edges grip the sheets successively which, because of the interfering pattern defined by the edges at the opening, clamp the sheet between the edges to project the free end above the package.

A piece of resilient compressible polymeric foam is placed in the package on the side of the stack opposite the dispensing opening to urge the stack of sheets toward the opening. The box-dispenser may have a removable cover or flap joined along one marginal edge of the box to cover the dispensing opening and the adjoining slits in the original point of sale package.

BRIEF DESCRIPTION OF THE DRAWINGS

The present invention will be further described with reference to the accompanying drawing wherein.

DESCRIPTION OF THE PREFERRED EMBODIMENTS

The present invention is directed to an improved package dispenser for sheets of material which are joined together along one edge thereof such that the sheets are joined along alternately opposite edges of successive sheets in such a manner that they may be separated by a peeling force applied against the edge of the successive sheets. The sheets may be preferably adhered together by a narrow band of pressure-sensitive adhesive or by another substance which has greater shear strength than peel strength such that pulling on one sheet to draw the same through the opening of the dispenser will cause the next adjacent sheet to buckle and the adjacent end to be drawn from the stack through the exit opening with the dispensed sheet. The dispensed sheet then applies a peel force against the edges of the sheets to separate them.

Figure 1:
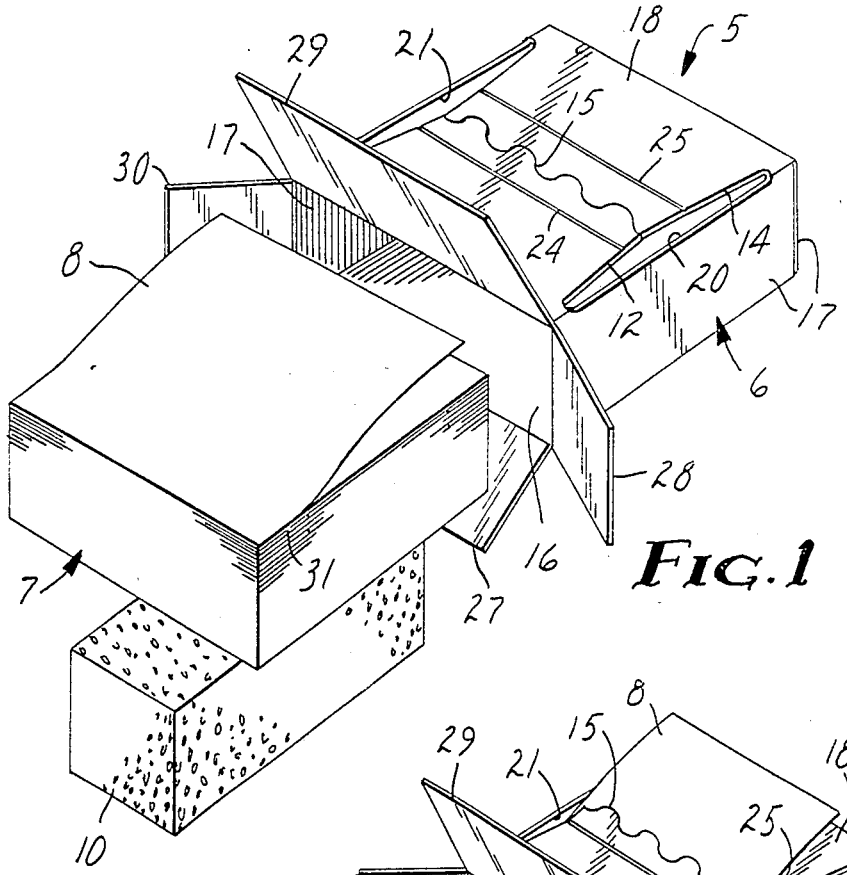
FIG. 1 is an exploded perspective view of the package-dispenser of the present invention with the parts separated.
Figure 2:
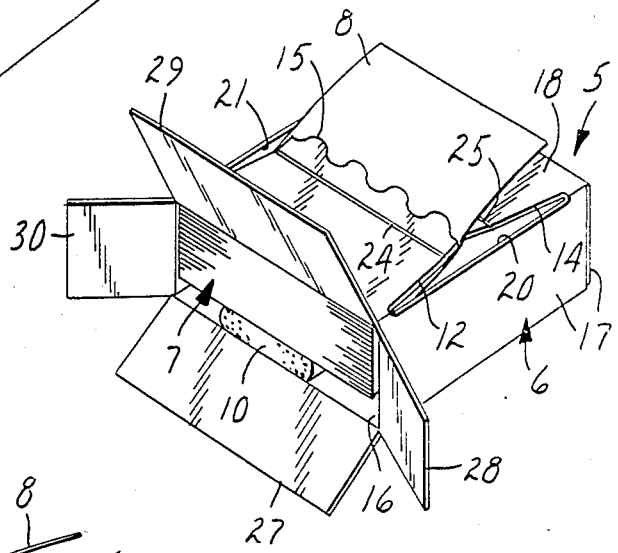
FIG. 2 is a perspective view of the package-dispenser with the parts assembled.

Referring now to FIG. 1 there is illustrated a package-dispenser 5 constructed according to the present invention. The dispenser comprises a box-like outer package 6 in which is placed a stack 7 of sheets 8 of a corresponding size and shape, and a piece of resilient compressible polymeric material 10.

The package-dispenser 5 is formed in the general shape of a box 6 to contain the stack 7 of sheets 8. The box has an opening in the top or cover and a pair of mating flaps 12 and 14 which define therebetween a dispensing opening 15. The box 6, as illustrated in the drawings, comprises a base 16 joined by four perpendicular side walls 17 and a top wall 18 for enclosing the stack 7 of sheet material 8. The top wall 18 is formed with a pair of slits or cut portions 20 and 21 which define an opening and the flaps 12 and 14 which separate at a wave shaped slot to define the opening 15 in the top of the package through which the sheets 8 may be dispensed. The flaps 12 and 14 serve to fulcrum the end near the opening 15 and the length of the slits 20 and 21 give the flaps the desired resilience or spring action which is inherent in the rigidity or elasticity of the material. Score lines on fold lines 24 and 25 are formed near the ends of the flaps to permit some bending of the ends with respect to each other. This allows the full end of the dispensed sheets 8 to project above the package.

A preferred material for forming the package dispenser is a twenty point box board stock which may be cut into a blank. The blank is formed with panels and flaps which fold to form the box and the side walls 17. The flaps, such as the flaps 27, 28, 29 and 30 may be sealed after the stack of sheets is inserted along with the compressed piece of polymeric foam.

The package-dispenser box can be formed from materials other than box board, such materials include polymeric film, plastic, paper or the like.

Figure 3:
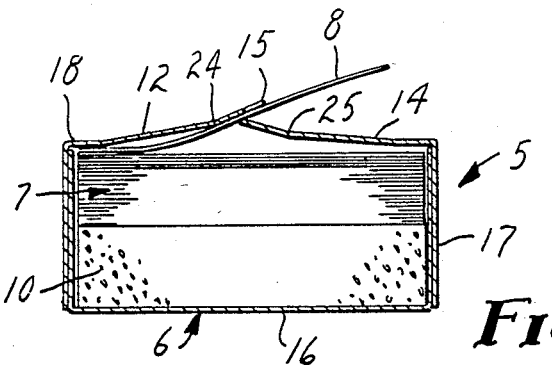
FIG. 3 is a vertical sectional view showing the package with a portion of the sheets in the stack removed.

The piece of foam material 10 is readily compressible foam and is compressed to fit in the box 6 between the stack 7 and the base 16. The foam provides a force to raise the sheets 8 toward the opening 15. As a sheet 8 is removed the next adjacent sheet buckles and the opening between the score lines 24 and 25 expands. The shear strength of the adhesive, indicated at 31 in FIG. 1, then pulls the free end of the next sheet out of the opening 15. The next sheet then is caught between the overlapping edges of the flaps defining the opening and it sticks straight from the opening as illustrated in FIG. 3.

The illustrated package-dispenser is provided with the exit opening 15 defined by an undulated cut in the material to form an undulatd edge on the flaps. this undulated edge could be a saw-tooth edge, sine wave shaped, square wave shaped edge or the like. In such an opening a sheet disposed in the opening between the flaps is held by one flap against the extended ends of the other flap.

A specific example of the package-dispenser is a box enclosing a stack of 300 sheets of 20 pound bond paper 2.94 inches (7.46 cm) by 3.06 inches (7.78 cm). The box is formed of 20 point box board and has outside dimensions of $3.18 \times 3.125 \times 1.69$ inches ($8.096 \times 7.94 \times 4.29$ cm). The fixed edge of the flaps or the position of flexure of the flaps is spaced 0.375 inch (0.1 cm) from the edge of the box and have interference of undulations at the opening of 0.187 to 0.5 inch (4.76 to 12.7 mm). An example of the adhesive material is a pressure-sensitive repositionable acrylate copolymer adhesive, as described in U.S. Pat. No. 3,691,140 assigned to the assignee of this application, coated in a strip adjacent the edge of each sheet 0.25 inch (6 mm) to 0.75 inch (19 mm) wide. The band of adhesive material would not exceed one-half the dimension of a sheet measured from the edge.

The piece of foam when compressed supports a majority of the area of the stack and may be a piece of soft foamed urethane polymer measuring 1.25 inches (3.17 cm) in width, 1.5 inches (3.8 cm) in height and 3 inches (7.6 cm) in length. The block of foam as described is greater than half the height of the inside of the box and is resilient and compressed to be inserted with the stack of sheets into the box. As the foam expands it lifts the sheets toward the opening.

The score lines 24 and 25 are preferably spaced 0.375 inch (9.5 mm) from the center line of the opening 15. The spacing of the score or fold lines depends on the amount of the overlap of the edges defining the dispensing opening. The score lines could be spaced from the center line by a distance equal to the height of the undulations. The dispensing opening can be defined by straight edges in overlapping position with score lines.

Suitable graphics and designs or logos may be printed on the package-dispenser 5 to make it attractive and to serve as an advertising medium.

While one embodiment of the invention is disclosed, it is to be understood that changes other than those mentioned may be made in details thereof without departing from the spirit or scope of the invention as claimed.

I claim:

1. A package of sheet material comprising a box-like structure for enclosing a stack or sheet material with said sheets releasably adhered to each other in the stack along opposite edges of successive sheets, said structure comprising a base, side walls joined together and interconnecting said base with a cover, said cover having an opening extending across said cover and centrally positioned symmetrically through which the sheet material may be dispensed and flap means projecting into said opening and terminating at mating undulated free edges wherein the undulations on one edge extend past the undulations of the other edge affording engagement with the sheets being dispensed between said edges for grasping said sheets, and a piece of inherently resilient material shaped to be compressed and inserted in the box-like structure on the side of a said stack opposite the cover for urging a said stack of sheets toward said cover and the flap means in the dispensing opening.

2. A package according to claim 1 wherein said resilient material is polymeric foam.

3. A package according to claim 2 wherein the polymeric foam is a piece of urethane foam.

4. A package according to claim 1 wherein said sheets in a said stack of sheet material is releasably adhered to each other by a band of pressure-sensitive adhesive and are positioned in said structure to permit the adhesive free edge of the top sheet to be positioned through and generally parallel to said edges of said opening and said resilient material is a polymeric foam.

5. A package according to claim 4 wherein said flap means comprise resilient flaps extending into said opening, said flaps have said free edges which mate along scalloped edges and score lines are provided on said flaps which score lines extend across said flaps spaced from said free edges to permit flexure of said flaps adjacent said free edges during dispensing of said sheets.

6. A package according to claim 4 wherein said band of adhesive is not greater than one-half the width of the sheet.

* * * * *